US008459751B2

(12) United States Patent
Andrina

(10) Patent No.: US 8,459,751 B2
(45) Date of Patent: Jun. 11, 2013

(54) PERCUSSION TOOL FOR A DEMOLISHING HAMMER OR THE LIKE

(76) Inventor: Giovanni Andrina, Bosconero (IT)

( * ) Notice: Subject to any disclaimer, the term of this patent is extended or adjusted under 35 U.S.C. 154(b) by 61 days.

(21) Appl. No.: 13/315,520

(22) Filed: Dec. 9, 2011

(65) Prior Publication Data

US 2012/0153706 A1 Jun. 21, 2012

(30) Foreign Application Priority Data

Dec. 20, 2010 (IT) ..... TO2010A1023

(51) Int. Cl.
*E21C 35/197* (2006.01)
*E21B 1/12* (2006.01)

(52) U.S. Cl.
USPC ..... 299/100; 299/69; 299/113

(58) Field of Classification Search
USPC ..... 299/100, 113, 104, 69, 107; 175/414, 175/415
See application file for complete search history.

(56) References Cited

U.S. PATENT DOCUMENTS

| | | | | | |
|---|---|---|---|---|---|
| 398,308 | A | * | 2/1889 | Barth | 299/101 |
| 431,239 | A | * | 7/1890 | Walter | 173/24 |
| 480,979 | A | * | 8/1892 | Turner | 279/101 |
| 752,180 | A | * | 2/1904 | Rauscher | 173/24 |
| 1,355,793 | A | | 10/1920 | Bernay | |
| 3,807,804 | A | | 4/1974 | Kniff | |
| 4,804,231 | A | * | 2/1989 | Buljan et al. | 299/113 |

* cited by examiner

*Primary Examiner* — David Bagnell
*Assistant Examiner* — Michael Goodwin
(74) *Attorney, Agent, or Firm* — David A. Farah; Sheldon Mak & Anderson PC

(57) ABSTRACT

A percussion tool for a demolishing hammer or the like, comprises an elongated body that has a first portion aimed to be connected with the demolishing hammer and a second portion, opposite to the first portion, that includes a working bit. The two portions are made of mutually different materials and are rigidly connected by means of a connection member that can be applied outside the portions. Both portions of the tool have formations that can be engaged by corresponding formations of the connection member.

9 Claims, 2 Drawing Sheets

PERCUSSION TOOL FOR A DEMOLISHING HAMMER OR THE LIKE

CROSS-REFERENCE TO RELATED APPLICATION

The present Application claims priority from Italian Patent Application No. TO2010A001023 filed on Dec. 20, 2010, the contents of which are incorporated in this disclosure by reference in their entirety.

BACKGROUND

1. Field of the Invention

The present invention refers in general to percussion tooling that can be used in perforation, demolition or excavation operations.

2. Background Art

Known percussion tools of the type mentioned above comprise a first portion, that, when operating, is housed at least partly inside the hammer, and a second portion that includes a working bit. Normally, such tools are manufactured in a single piece of a material, typically steel, chosen in order to satisfy a compromise between two opposite needs. In fact, the first portion of these tools, whose upper end is cyclically subjected to impacts of a high amount due to the percussion action performed by a beating mass moving inside the hammer, requires a mean hardness and a high flexural strength and a high resistance to impacts, and therefore a good elastic resistance. The second portion of such tools, that is subjected to impacts against the material to be demolished, requires a high hardness and toughness and a high resistance to hot wear. Since such known tools are made in a single piece, steel used for making them is chosen in order to be able to simultaneously satisfy the required requirements for both above portions, and therefore has not wholly optimum characteristics either for the first or for the second portion. In particular, for the whole tool, steels are used that are alloyed with elements such as nickel, molybdenum, chromium, vanadium and similar metals, many of which, being rather costly, affect the global tool cost.

It would instead be desirable to be able to have tools available of the above-defined type whose material has different characteristics for each portion, so that the two portions are suitable for supporting the types of specific stresses to which each one of them is subjected during use.

In principle, it can be deemed that the first portion of the tool provides a contribution approximately for 85% of the weight, while the second portion, equipped with the working end, gives a contribution approximately for 15% of the weight. The two tool portions could be made separately with different materials, each one chosen to optimally bear its related stresses. In this way, the first portion could be made of a chromium-molybdenum or chromium-manganese alloyed steel, relatively inexpensive, while the second portion could be made of a highly specialized steel, with high resistance to hot wear, for example alloyed with tungsten and cobalt, and therefore relatively more expensive but only in relation to a small part of the tool.

In this way, much better tool performances could be obtained with greater reliability and use length, at a lower cost than the one required for making the tool wholly with a high-performance steel alloy.

There is anyway the problem, having a difficult solution, of managing to guarantee a connection of these two portions that is rigid, stable in time and reliable. In particular, the most common types of connection, for example of the screw and nut screw type, are absolutely unsuitable to resist in time to the high pulse stresses to which a tool of the type herein described is subjected.

Document BE-A-440648 discloses a percussion tool according to the prior art.

SUMMARY OF THE INVENTION

In particular, object of the invention is proposing a tool of the above-defined type, whose two portions are each one made of an optimum material for bearing the stresses applied thereto during use, and that are mutually connected in a high reliable and lengthy way.

This object is obtained due to a tool having the characteristics mentioned in the enclosed claims.

In particular, according to the invention, the two tool portions are made of mutually different materials, and are mutually rigidly connected by means of a connection member that can be applied outside the two portions, both portions having formations adapted to be engaged by corresponding formations of the connection member.

Due to this arrangement, each one of the two tool portions is made of a material that allows optimally bearing the stresses applied during use, and therefore the tool length is strongly increased. Moreover, the connection member allows rigidly connecting its two portions in a wholly reliable way. Since the two portions are mutually connected, it is also possible, according to needs, to replace only one of the two portions, after having removed the connection member.

According to a preferred feature of the invention, the connection member is a metallic ring.

In this way, the connection member is composed of an element that is simple and inexpensive to make.

According to another preferred feature of the invention, the two tool portions have respective circumferential grooves next to the related ends aimed to be mutually connected, whose grooves are aimed to be engaged by corresponding radial ribs of the metallic ring.

BRIEF DESCRIPTION OF THE DRAWINGS

Further characteristics and advantages of the invention will more clearly result from the following detailed description, provided as a non-limiting example and referred to the enclosed drawings, in which.

DETAILED DESCRIPTION OF PREFERRED EMBODIMENTS

Figure 1:
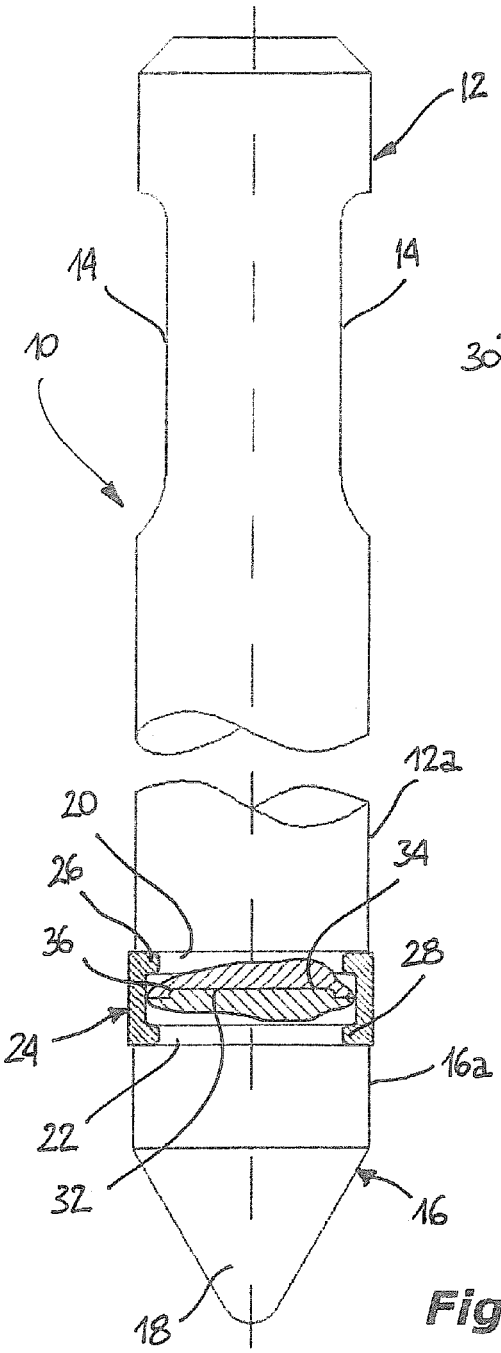
FIG. 1 is a schematic, side elevational, partially sectioned view of a tool according to the invention.

With reference firstly to FIG. 1, a percussion tool for a demolishing hammer, for example with pneumatic or hydraulic actuation, is globally designated as 10. The tool 10 has a body with a generally cylindrical, elongated shape, typically with a circular cross section, made of steel alloyed with other metals depending on the desired resistance characteristics.

The tool 10 has a first portion 12 aimed to be housed at least partially inside the body of the demolishing hammer (not shown in the figures), whose upper end (with reference to FIG. 1) is aimed to be subjected to impacts applied by a beating mass of a known type, moving inside the hammer body. The portion 12, in a per se known way, comprises a pair of diametrically opposite flattened parts 14, in order to allow keeping the tool 10 inside the hammer.

The tool 10 further comprises a second portion 16 aimed to be connected to the first portion 12, which has a working end 18, on the opposite part of the portion 12. The end 18 can be shaped differently depending on the type of working to be made and the type of material to be treated, and can therefore be shaped as a chisel, cone, pyramid, or plate.

While the first portion 12 is made of a metallic material, typically steel, with high elasticity characteristics, the second portion 16 is made of a metallic material, also typically steel, with high hardness characteristics and high resistance to hot wear. The portion 12 can be made with a chromium-molybdenum or chromium-manganese alloyed steel, while the portion 16 can be made of tungsten or cobalt alloyed steel.

In order to mutually connect the two portions 12 and 16 in a rigid and reliable way, a connection member 24 is used, preferably shaped as a metallic ring. The ring 24 is applied from outside onto the two portions 12 and 16 after having placed them in contact next to respective ends 12*a* and 16*a*.

In particular, next to the two ends 12*a* and 16*a* of the two portions 12 and 16, engagement formations are obtained, typically circumferential grooves 20 and 22, that can be engaged by corresponding formations, typically annular ribs composed of radial collars 26 and 28 of the ring 24.

Preferably, the grooves 20 and 22 have a slightly tapered cross section in order to be converging towards the general axis of the tool 10, and/or tapered edges, in order to decrease the stress concentration next to the related edges and to enable the engagement of collars 26 and 28 therein. The collars 26 and 28 of the ring 24 conveniently have a cross section corresponding to the related grooves 20 and 22.

In order to allow applying the ring 24 next to the ends 12*a* and 16*a* of the portions 12 and 16, it has at least one opening aimed to be closed after assembling onto the tool 10.

Figure 2:
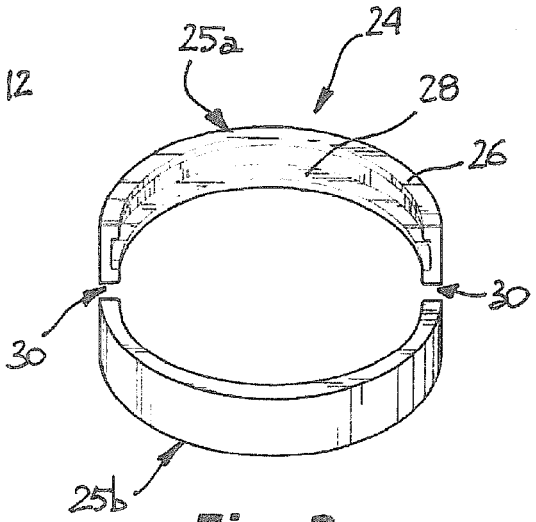
FIGS. 2 and 3 are enlarged perspective views, each one of which shows a connection member of the two tool portions of FIG. 1.

According to a first variation of the ring 24 and with reference to FIG. 2, it is made of many sectors, for example two semicircular sectors 25*a*, 25*b*, separated by openings 30. These openings, after having assembled the ring 24, are closed through respective weldings performed next to the adjacent ends of the sectors 25*a* and 25*b* of the ring 24, in order to make the ring as one piece after its assembling onto the tool 10.

The openings 30 can have different shapes, for example extending axially or diagonally, in this latter case in order to increase the length of the contact surfaces between the ends of the various sectors of the ring 24 and to distribute the load also along a tangential component.

Figure 3:
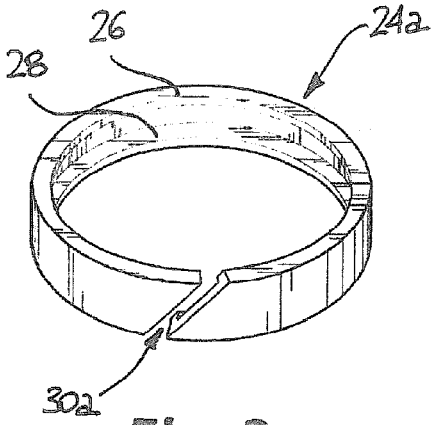

According to a variation shown in FIG. 3, in which the ring is designated with 24*a*, this is an elastic ring that has a diagonal, or, alternatively, axial opening 30*a*. The elastic ring 24*a* can be slightly widened to allow its sliding along the external surface of one of the portions of the tool 10, till it engages its collars 26 and 28 into the grooves 20 and 22 of the portions 12 and 16. Conveniently, at the end of the assembling step of the ring 24*a*, its opening 30*a* can be closed through welding, after the ring 24*a* has been brought back to its undistorted condition.

In any case, the connection member 24, 24*a*, 24*b* or 24*c* can be removed to allow, if needed, replacing one of the portions 12 or 16, in the most common case the second portion 16 following the wear of the working bit 18. After having replaced the affected portion, the removed connection member can be re-used, or a new connection member can be used as replacement of the previous one.

In order to guarantee a correct and accurate mutual positioning of the two ends 12*a* and 16*a*, they preferably have respective radial centering formations. For such purpose, at the axial end 12*a* of the portion 12, a recess 32 can be formed, for example with a cylindrical shape, while from the axial end 16*a* of the portion 16 a corresponding projection 34 can extend, or vice versa. In the most common case, both recess 32 and projection 34 will have a circular shape and their edges will have fitting areas 36 to avoid the stress concentration. Alternatively, the recess 32 and the projection 34 can be shaped in such a way as to prevent the relative rotation of the two portions 12 and 16, in which case they can have a triangular, squared, hexagonal, cross-like or star-like shape, or any other shape useful to obtain such result.

In this way, the mutual centering of the two ends 12*a* and 16*a* is guaranteed by the engagement of the projection 34 into the recess 32.

Figure 4:
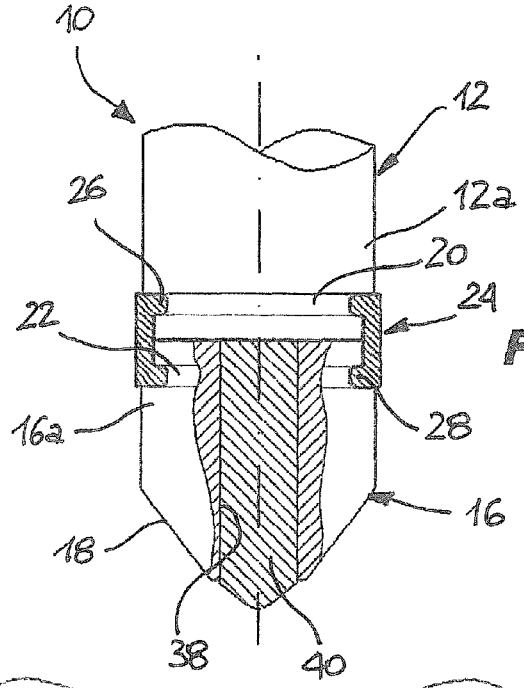
FIGS. 4 to 6 are views similar to FIG. 1, which partially show respective variations of the tool according to the invention.

FIG. 4 shows a variation of the invention, in which the portion 16 of the tool 10 comprises an axial insert 40 made of hardened metal having a bit projecting from the opposite end to the first portion 12. The insert 40 engages an axial through-hole 38 that extends till the end of the portion 12*a* and that crosses the whole portion 18. Since the two portions 12 and 16 are made as two separate pieces, it is easy to obtain the hole 38 into the portion 16 for inserting the insert 40, with the further advantage that the hole 38 will not have a blind bottom with sharp edges, with the unavoidable stress concentration, as necessarily happened in case of a tool made in a single piece.

Figure 5:
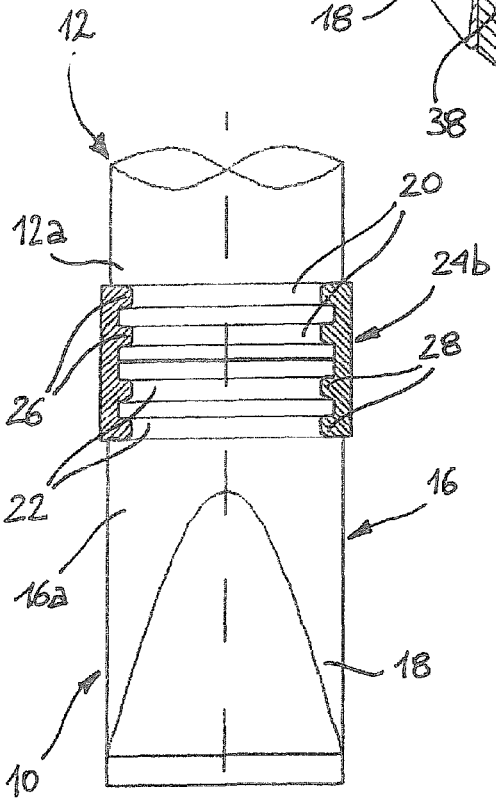
Figure 6:
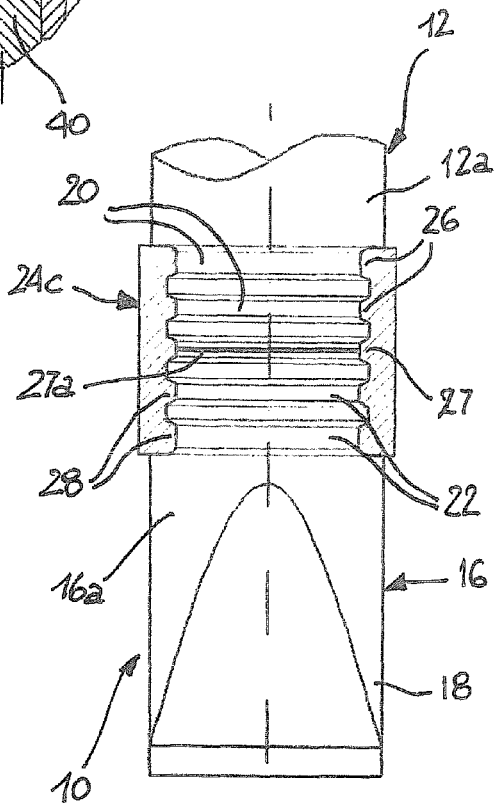

FIGS. 5 and 6 show respective variations of the tool 10 in which the connection rings, here designated with 24*b* and with 24*c*, respectively have four and five ribs engaged into corresponding grooves 20 and 22 obtained in the ends 12*a* and 16*a*. In particular, the variation of FIG. 6 also comprises an intermediate groove 27*a*, obtained half in the end 12*a* and half in the end 16*a*, in which a central rib 27 of the ring 24*c* is engaged.

Although the present invention has been discussed in considerable detail with reference to certain preferred embodiments, other embodiments are possible. Therefore, the scope of the appended claims should not be limited to the description of preferred embodiments contained in this disclosure.

I claim:

1. A percussion tool for a demolishing hammer, comprising an elongated body, the elongated body having a first portion adapted to be connected to the demolishing hammer and a second portion, opposite to the first portion, the second portion including a working end, the first portion being made of a first material, and the second portion being made of a second material which is different from the first material, the first portion and the second portion being mutually and rigidly connected by means of a connection member;

wherein the connection member is adapted to be applied outside the first portion and the second portion and is a metallic ring;

wherein the first portion and the second portion have respective circumferential grooves next to the first end and the second end to be mutually connected, wherein the grooves are engaged by corresponding radial ribs of the metallic ring; and wherein, at a first axial end of the first portion, a recess is formed, the recess being engaged by a corresponding projection, the projection extending from a second axial end of the second portion, the recess and the projection having such a shape as to prevent a relative rotation of the first portion and the second portion.

2. The tool of claim 1, wherein the first portion is made of a metallic material having higher flexural strength characteristics than the second portion, and the second portion is made of a metallic material having higher hardness characteristics and higher resistance to hot wear than the first portion.

3. The tool of claim 1, wherein the circumferential grooves and the ribs have a cross section that is at least slightly converging towards an axis of the tool.

4. The tool of claim 1, wherein the metallic ring has at least one opening adapted to be closed after having assembled the ring next to the first end and the second end of the first portion and the second portion.

5. The tool of claim 4, wherein the metallic ring has at least two sectors, and, after having assembled the metallic ring onto the first portion and the second portion of the tool, adjacent ends of the sectors are mutually secured through welding.

6. The tool of claim 4, wherein the metallic ring is an elastic ring that has an axial or diagonal opening.

7. The tool of claim 6, wherein the opening of the elastic ring is adapted to be closed through welding.

8. The tool of claim 1, wherein the recess and the projection have a cylindrical shape.

9. The tool of claim 1, wherein the second portion has an axial through-hole engaged by an insert made of hardened steel having a bit projecting opposite to the first portion.

* * * * *